US011976404B2

(12) United States Patent
Brignone

(10) Patent No.: US 11,976,404 B2
(45) Date of Patent: May 7, 2024

(54) WATER DISPENSING DEVICE FOR A WASHING APPLIANCE

(71) Applicant: BITRON S.p.A., Turin (IT)

(72) Inventor: Enzo Brignone, Dronero (IT)

(73) Assignee: BITRON S.p.A., Turin (IT)

( * ) Notice: Subject to any disclaimer, the term of this patent is extended or adjusted under 35 U.S.C. 154(b) by 709 days.

(21) Appl. No.: 17/260,833

(22) PCT Filed: Jul. 16, 2019

(86) PCT No.: PCT/IB2019/056045

§ 371 (c)(1),
(2) Date: Jan. 15, 2021

(87) PCT Pub. No.: WO2020/016763

PCT Pub. Date: Jan. 23, 2020

(65) Prior Publication Data

US 2021/0292960 A1 Sep. 23, 2021

(30) Foreign Application Priority Data

Jul. 17, 2018 (IT) ..... 102018000007257

(51) Int. Cl.

| | |
|---|---|
| ***D06F 37/42*** | (2006.01) |
| ***A47L 15/42*** | (2006.01) |
| ***D06F 39/08*** | (2006.01) |

(52) U.S. Cl.

CPC ..... *D06F 37/42* (2013.01); *A47L 15/4214* (2013.01); *A47L 15/4217* (2013.01); *D06F 39/088* (2013.01)

(58) Field of Classification Search

CPC .... D06F 37/42; D06F 39/088; A47L 15/4214; A47L 15/4217

See application file for complete search history.

(56) References Cited

U.S. PATENT DOCUMENTS

2004/0231976 A1* 11/2004 Gadini ..... A47L 15/4229 204/240
2005/0241675 A1 11/2005 Jung et al.
2015/0107309 A1* 4/2015 Favaro ..... D06F 39/007 68/17 R
2015/0368847 A1* 12/2015 Del Pos ..... D06F 34/28 68/17 R

FOREIGN PATENT DOCUMENTS

CN 205173589 U 4/2016
CN 107995853 A 5/2018

(Continued)

OTHER PUBLICATIONS

Electronic translation of EP-2361542-A2 to Jerg. (Year: 2011).*

(Continued)

*Primary Examiner* — Joseph L. Perrin
(74) *Attorney, Agent, or Firm* — Sughrue Mion, PLLC

(57) ABSTRACT

A water dispensing device for a washing appliance has a body and a lid defining an internal cavity and, within the internal cavity, a flow conduit for water from an inlet to an outlet. On the flow conduit an air-break is provided. One or more non-return valves are arranged on the flow conduit within the internal cavity and upstream of the air-break.

14 Claims, 7 Drawing Sheets

(56) References Cited

FOREIGN PATENT DOCUMENTS

| | | | | |
|---|---|---|---|---|
| EP | 0 565 876 | A1 | 10/1993 | |
| EP | 2361542 | A2 * | 8/2011 | ..... A47L 15/4217 |
| EP | 3 192 424 | A1 | 7/2017 | |
| WO | 2016/203438 | A1 | 12/2016 | |

OTHER PUBLICATIONS

International Search Report for PCT/IB2019/056045 dated Sep. 18, 2019 (PCT/ISA/210).
Written Opinion of the International Searching Authority for PCT/IB2019/056045 dated Sep. 18, 2019 (PCT/ISA/237).
Communication dated Jul. 19, 2022 from the Chinese Patent Office in Chinese Application No. 201980047728.0.

* cited by examiner

WATER DISPENSING DEVICE FOR A WASHING APPLIANCE

CROSS-REFERENCE TO RELATED APPLICATIONS

This application is a National Stage Application of International Patent Application No. PCT/IB2019/056045, having an International Filing Date of Jul. 16, 2019, which claims the benefit of priority to Italian Patent Application No. 102018000007257, filed Jul. 17, 2018, the entire contents of which are hereby incorporated by reference herein.

FIELD OF THE INVENTION

The present invention refers to a water dispensing device for washing appliances, such as dishwashers and washing machines, that are to be connected to the water supply network.

BACKGROUND OF THE INVENTION

A device of this kind typically comprises a flattened and hollow plastic body, which is connected to other components of the appliance and shaped whereby it may perform various functions, such as vent for the vapors that form in the washing tub, collection of water intended to form the regeneration brine of the ion exchange resins of the decalcifier, container for these resins, anti-backflow safety device and so on.

In particular, the anti-backflow safety function prevents the water already present in the appliance, and therefore no longer classifiable as potable, from flowing back into the water supply network in the event of a loss of pressure in the latter.

According to regulations, the liquids contained in a washing appliance are classified into 5 categories, numbered from 1 to 5, where 1 corresponds to potable water, 2 and 3 to liquids, such as water, containing substances not harmful to humans, such as salt, and 4 and 5 to liquids, such as water, containing substances potentially dangerous to humans, such as detergents for clothes or dishes.

Similarly, standards, for example the standard EN 61770, classify anti-backflow systems on the basis of their suitability to prevent the return to the network of the aforesaid liquids classified in categories 2 to 5 and specify their characteristics.

For example, in anti-backflow systems for category 4 and 5 liquids, there is provided a non-pressurized nozzle from which water falls freely into a collection chamber at ambient pressure with a minimum distance of at least 20 mm between the free surface of the collected water and the nozzle, or a first nozzle which directs the water to a second nozzle at a distance of at least 20 mm from a free space in the air operating at ambient pressure, or a water guiding element, for example, but not necessarily, shaped like a crescent, with a missing wall portion facing a non-pressurized environment. All such systems are commonly referred to as "air-breaks" (or "air gaps") and are operated in an environment at atmospheric pressure. The term "air-break" therefore means a device that prevents the water to be fed into the washing tub from returning to the water supply network.

On the other hand, for anti-backflow systems for liquids of category 2 and 3, for example according to the standard EN 61770, devices involving the use of non-return valves known per se, which must meet specific operational and locking requirements, are accepted.

The water dispensing devices for the latest generation of household appliances are typically equipped with two anti-backflow systems in series, the first for liquids of category 2/3 and the second for liquids of category 4/5.

SUMMARY OF THE INVENTION

One of the objects of the present invention is thus to provide a water dispensing device equipped with the two aforesaid anti-backflow systems having an operation which is safe and reliable, and which is simple and economical to produce.

According to the invention, this object is achieved by a water dispensing device for a washing appliance, including a body and a lid that define an internal cavity and, within said cavity, a water flow conduit from an inlet to an outlet, on said flow conduit there being present an air-break, the aforesaid device being characterized in that at least one non-return valve is arranged on said flow conduit within said cavity and upstream of the air-break. It should be noted that the expression "at least one non-return valve" refers to any number of valves and in particular to the presence of a first and a second valve. Preferred embodiments of the water dispensing device of the present invention are also described in the claims dependent on claim 1.

A further subject of the present invention is a production process of a water dispensing device of the type indicated above, wherein the aforesaid at least one non-return valve is assembled to said body, and then the lid is attached, in particular welded, to said body.

A further subject of the present invention is a washing appliance comprising a water dispensing device of the type described above.

The water dispensing device of the invention is simple and economical to be produced, because the non-return valve(s) may be placed in the internal cavity before attaching, typically by welding, the lid to the body.

The aforesaid non-return valve is an anti-backflow system for category 2/3 liquids, while the anti-backflow system for category 4/5 liquids is constituted in a way known per se of the air-break located downstream of the non-return valve, in order to guarantee a safe and reliable operation.

BRIEF DESCRIPTION OF THE DRAWINGS

Further advantages and features of the present invention will become apparent from the detailed description that follows, provided by way of non-limiting example with reference to the accompanying drawings, wherein.

DETAILED DESCRIPTION

Figure 1:
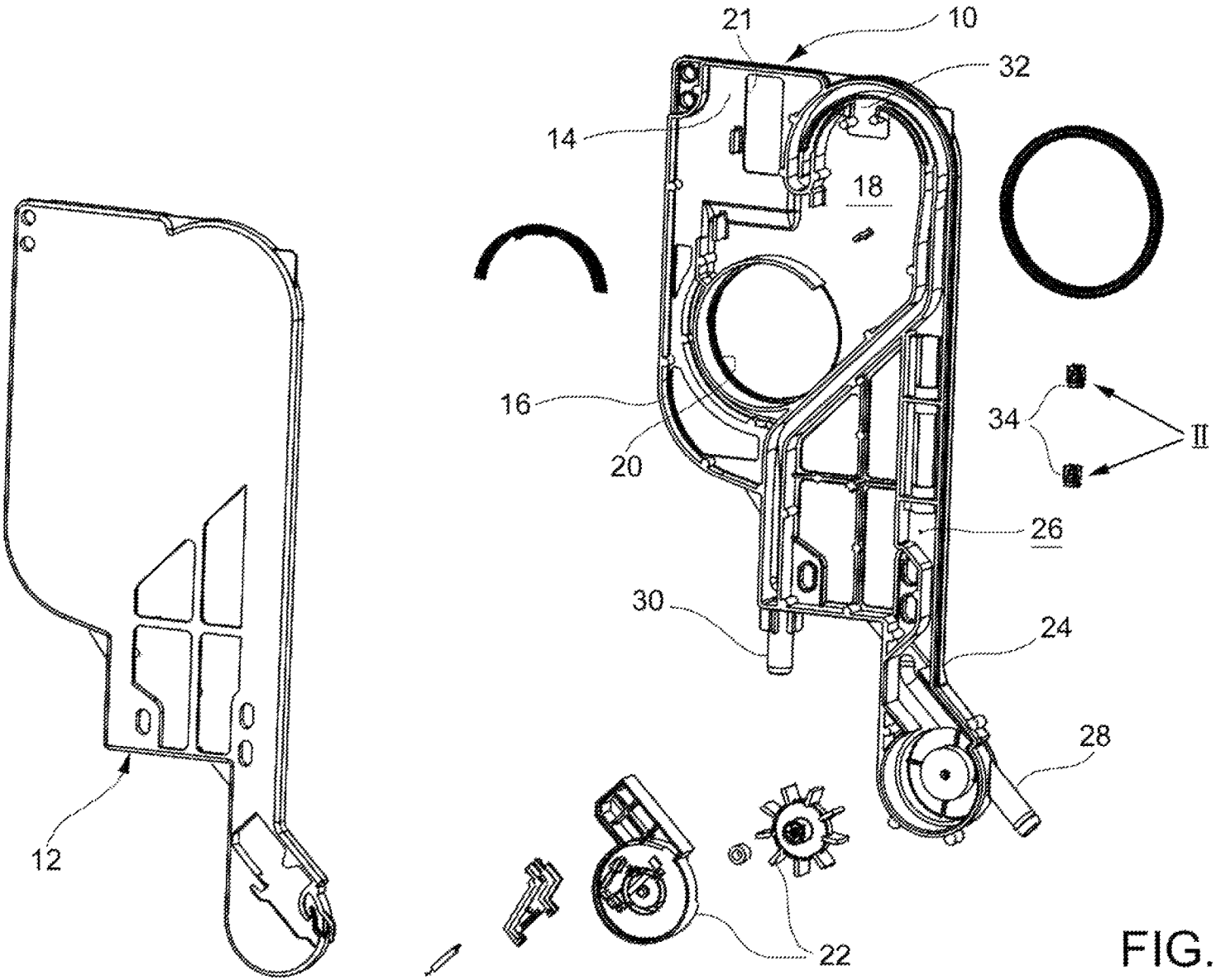
FIG. 1 is a schematic view in exploded perspective of a first embodiment of the device of the invention.

A water dispensing device for a washing appliance is composed (FIG. 1) of a body 10 and a lid 12, advantageously obtained by means of plastic injection molding.

The body 10 has a back wall 14 with a transverse wall 16 rising from the edge thereof.

The lid 12 has a shape corresponding to that of the back wall 14 and is fixed, in particular welded, to the upper edge of the transverse wall 16, so as to define an internal cavity 18. The device as a whole has a flattened shape and is intended to be mounted on the respective washing appliance with the back wall 14 and the lid 12 arranged in parallel in their respective vertical planes.

As is known, in the back wall 14 there is an intake hole 20 to connect the device to the washing tub of the appliance, and a hole 21 that defines the maximum water level that may be reached in the device and puts the device in communication with the ambient pressure. In addition, a flowmeter 22 is located in an appendage 24 of the device for measuring the amount of water treated thereby. From facing surfaces of the back wall 14 and of the lid 12, transverse walls extend, defining a water flow conduit 26 from an inlet sleeve 28 to an outlet sleeve 30. In undescribed but conventional embodiments, the sleeves 28 and 30 may be made differently: for example, the outlet sleeve 30 may be made as a drain of a different shape that flows directly into the washing tub of the appliance. In other cases, the outlet 30 coincides with the hole 20. In general, therefore, the conduit 26 may be defined as a conduit between an inlet 28 and an outlet 30 with the inlet 28 connected to the water supply network and the outlet 30 to the washing tub of the appliance. Always in a way known per se, on the flow conduit 26 there is an air-break 32, in particular of one of the types previously defined, of which only one is illustrated as an example in FIG. 1.

On a length of the flow conduit 26 downstream of the inlet sleeve 28 and the flow meter 22 and upstream of the air-break 32, two non-return valves 34 of the normally closed type are arranged in series.

Figure 2:
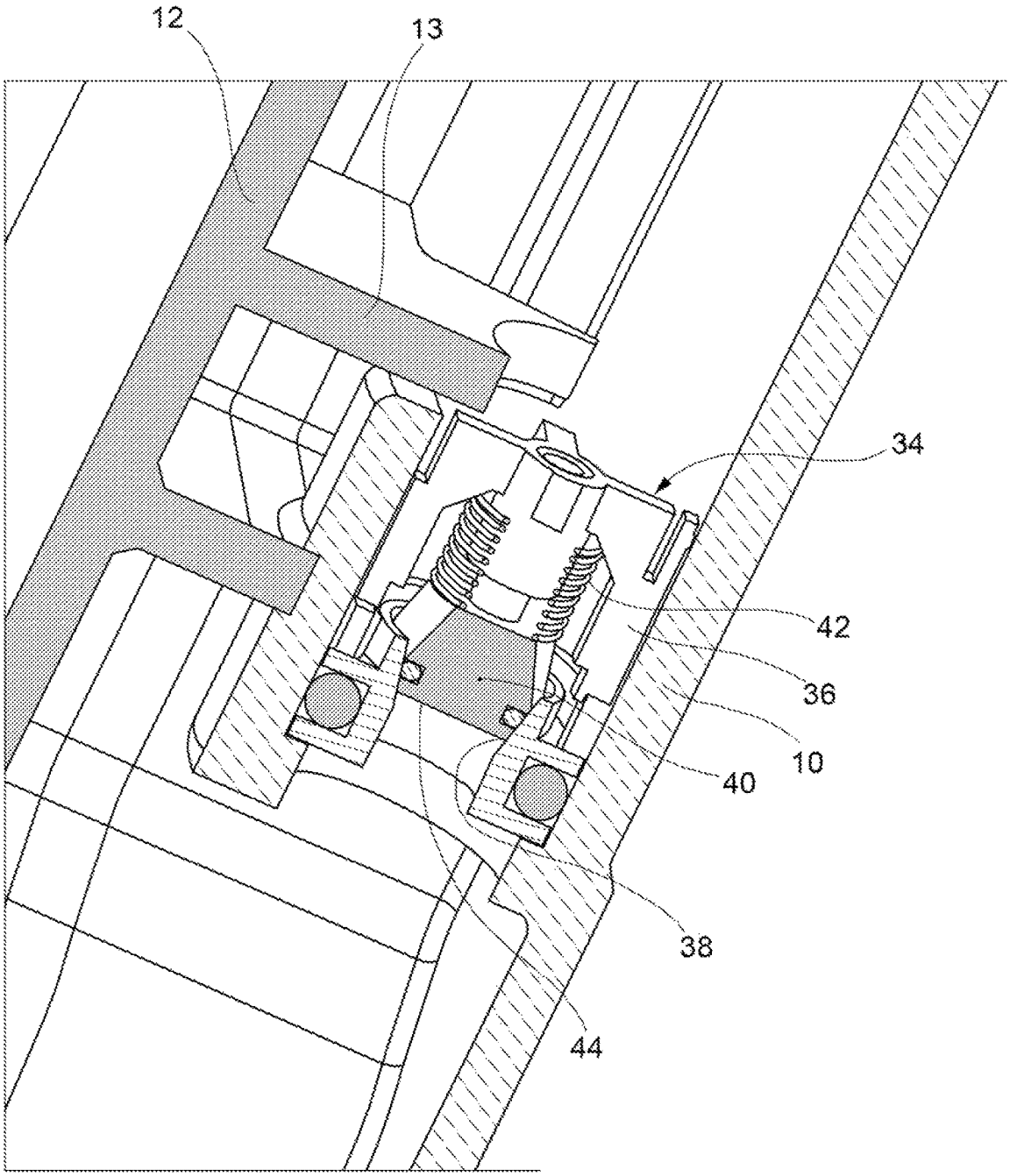
FIG. 2 is a perspective view on an enlarged scale of a detail of the device in FIG. 1.
Figure 3:
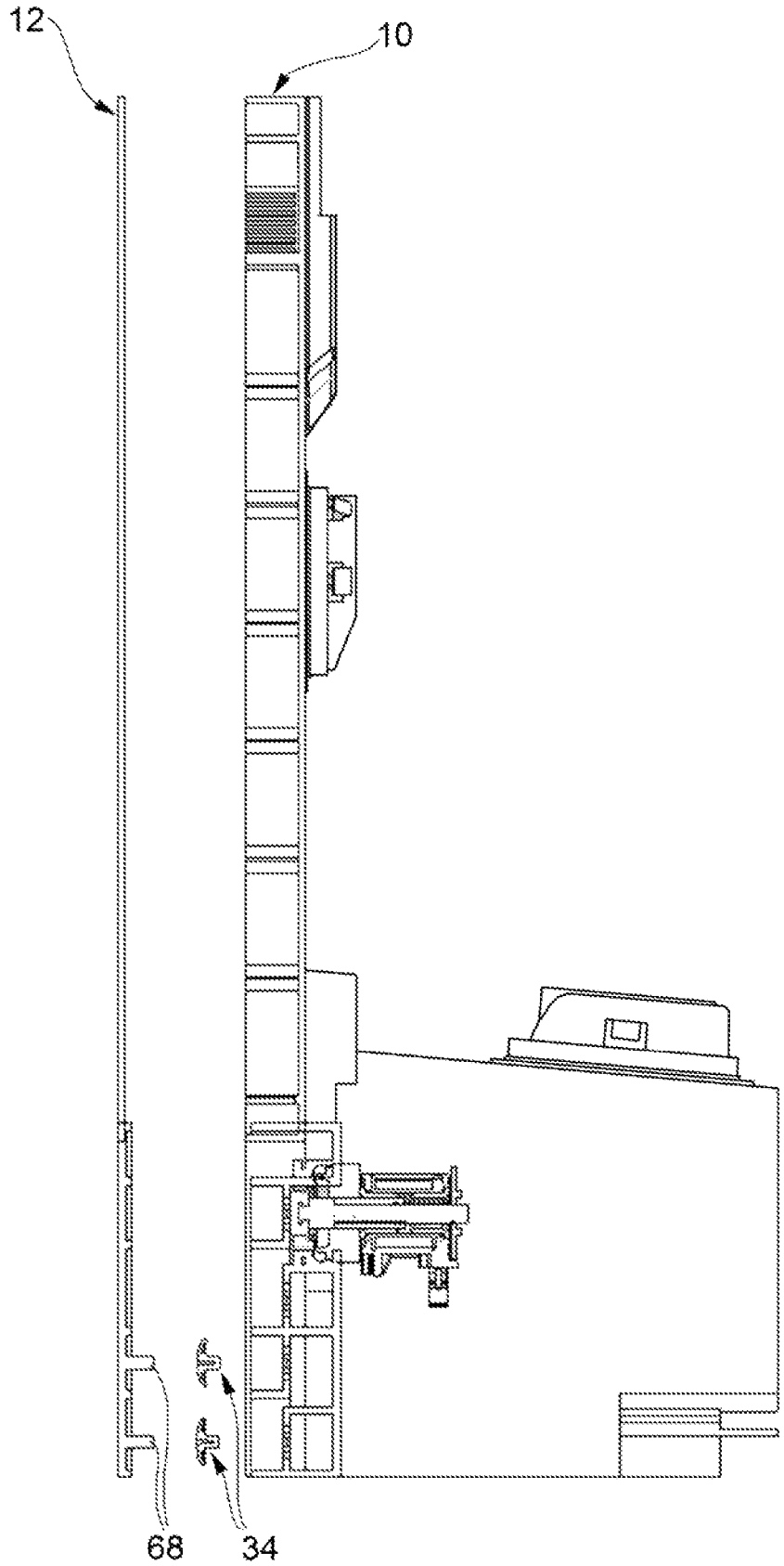
FIG. 3 is an exploded view in elevation of a second embodiment of the device of the invention.

Each valve 34, of conventional structure and operation per se, is composed (FIG. 2) of an external part 36 fixed within the flow conduit 26 and forming an abutment seat 38 for a shutter 40 the movement of which is opposed by an elastic member, such as a helical spring 42, for example metallic.

Normally, the water coming from the inlet sleeve 28 and flowing in the conduit 26 presses against the base 44 of the shutter 40 and, overcoming the resistance offered by the spring 42, causes the detachment of the shutter 40 from the abutment seat 38, allowing the outflow of the water downstream and thus its passage through the air-break 32 and outflow through the sleeve 30.

In the absence of water pressure against the base 44 of the shutter 40, the valve 34 is inevitably closed and prevents any backflow of water from the length of conduit 26 located downstream thereof. Each valve 34 is held in place against any dragging of the water flow that may dislodge it from its seat in the direction of the water flow by a corresponding protrusion 13 integral with the lid 12.

FIGS. 3 to 8, wherein the same reference numbers as those used with reference to the preceding figures indicate the same or equivalent parts, illustrate a further embodiment of the invention.

Also in this case, the device consists of a body 10 and a lid 12 welded together (FIGS. 3 and 4) so as to define an internal cavity 18 and a water flow conduit 26 from an inlet sleeve 28 to an outlet sleeve 30, in which two non-return valves 34 are placed in series. The water flow conduit 26 may generally extend from an inlet 28 to an outlet 30 which may also not be in the form of sleeves. For example, the outlet 30 may coincide in some embodiments with the hole 20 and allow the discharge of the water directly into the washing tub of the appliance.

Downstream of the valves 34, the conduit 26 crosses (FIG. 5) a containment chamber 45 for decalcifying resins and then continues to an air-break 32. The chamber 45 may also be considered as made by an enlargement of the conduit 26 and being a part thereof. This solution with a decalcifying resin containment chamber 45 is adopted in the case wherein the device is installed on machines that require a washing water treatment system. After the air-break 32, the water enters a final portion of the conduit 26 and exits from the outlet sleeve 30. The path normally followed by the water from the inlet to the outlet of the device is indicated by the reference number 74.

In order to be filled with decalcifying resins, the chamber 45 has (FIGS. 4 and 6) an upper opening 47 closed by a removable element 49. The latter comprises a plate 51 from which extend a plug 53, which closes the chamber 45, and a safety valve 55, which closes a by-pass conduit 57 arranged in parallel to the chamber 45 and opening into a further air-break 32 bis.

Normally, the valve 55 is closed, so that there is no flow in the by-pass conduit 57. However, in case of occlusions in the chamber 45, the water present in the conduit 57 causes the safety valve 55 to open and may thereby flow out following the alternative path 76 and avoiding the emergence of dangerous over-pressures which could generate possible breakages of the walls of the chamber 45 with an undesired water leakage.

The body 10 has (FIGS. 7 and 8) a Z-shaped projection that extends from a wall of the length of conduit at each valve 34 and has end portions **46*a*, 46*b* substantially transverse to the flow direction of the water in the conduit 26 and an intermediate portion 48 substantially parallel to the flow direction of the water in the conduit 26. The intermediate portion 48 has a through-hole 50 and at least one opening 52 also near the hole 50. Typically, there is a plurality of circular or slotted openings 52 arranged as a crown around the hole 50, or an annular opening 52** crossed by spokes staggered circumferentially.

Each non-return valve 34 consists of a single piece of elastic material, such as a synthetic or natural elastomer, shaped like an umbrella with a stem 54 and a cap 56, and substantially symmetrical with respect to a longitudinal axis 58 of the stem 54.

The stem 54 is inserted within the hole 50 and has a distal end 60 that protrudes beyond the intermediate portion 48, while the cap 56 has a perimeter edge 62 that abuts against the surface of the intermediate portion 48 on the opposite side with respect to the distal end 60 of the stem 54, so as to enclose a volume 64 between the internal surface of the cap 56 and the intermediate portion 48.

The central part of the cap 56 has a blind cavity 66 that extends along the axis 58, increasing the elasticity of the valve 34.

In this embodiment, the body 10 performs the water flow function within the valve 34, i.e. it performs a fundamental function of the structure of a valve. The body 10 is not substantially a simple support for a valve but rather performs a function essential to the operation thereof. In other words, in this embodiment, the fixed part 36 of the valve 34 shown in FIGS. 1 and 2 has been made in the material of the body 10 being a part thereof, forming on the body 10 the abutment seat 38.

From a portion of the surface of the lid 12 facing the intermediate portion 48, a pin 68 extends, the distal end of which comes into contact with the top of the cap 56, locking the stem 54 in the hole 50. On the surface of the lid 12 also a projection 70 protrudes, which constitutes the extension of the distal end portion 46*b* of the projection of the body 10.

The just described arrangement of the valves 34, and the fact that they are made of a single piece of elastic material, allows a decidedly simplified and rapid assembly thereof (from the front and without double movements on perpendicular axes to ensure the insertion) to the body 10, which is followed by welding the lid 12 along the line identified by the reference number 72.

In non-illustrated embodiments, the intermediate portion 48 could be perpendicular to the plane 14, in order to obtain a flow of water through the valve 34 in a direction parallel to the direction 74 of the water within the conduit 26.

During the operation of the device, the water flowing in the conduit 26 penetrates in the openings 52 and then in the volume 64 enclosed by the cap 56, causing only the perimeter edge 62 to rise and thus allowing the water to flow out downstream of the valve 34.

Figure 4:
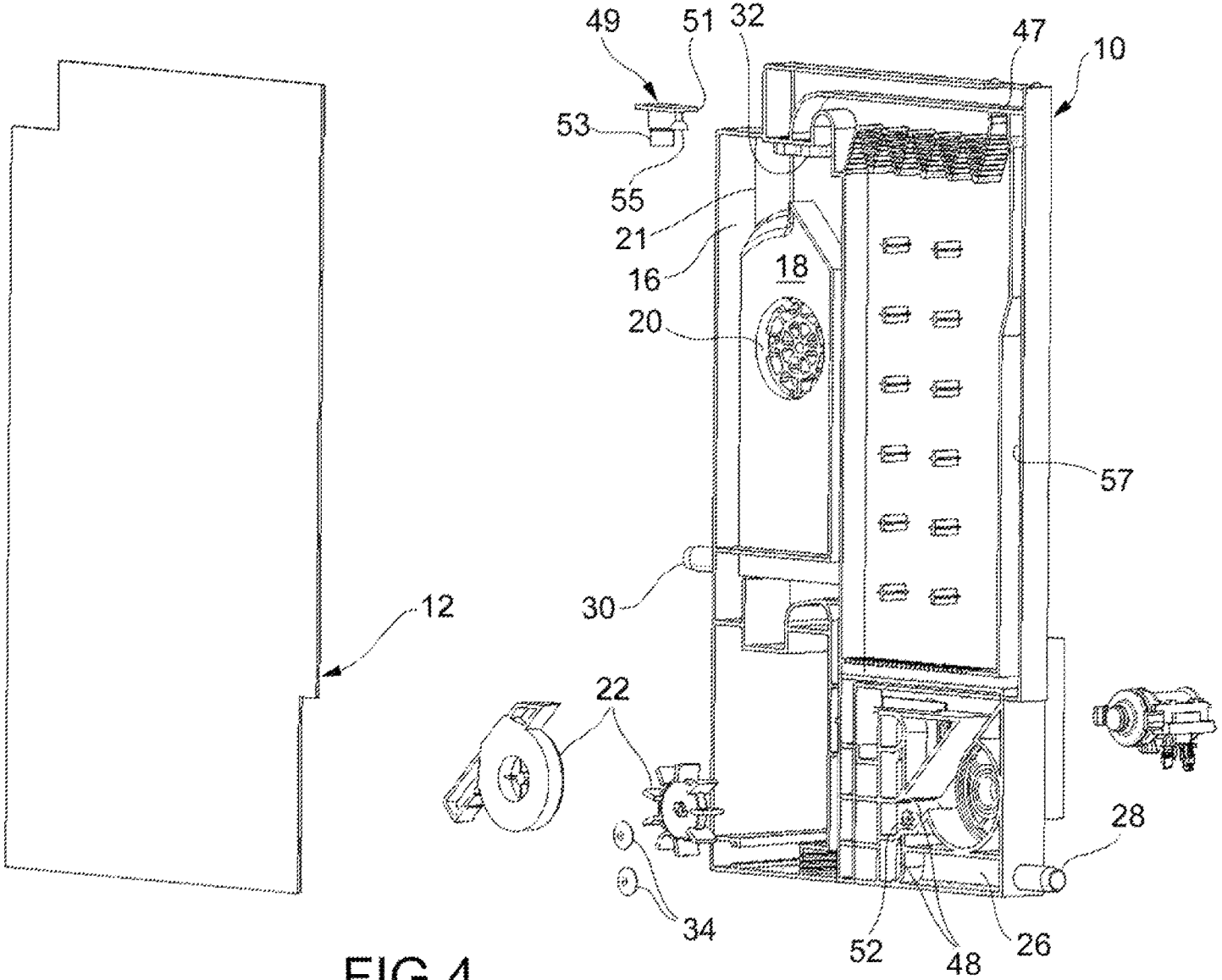
FIG. 4 is an exploded perspective view of the second embodiment of the device of the invention.
Figure 6:
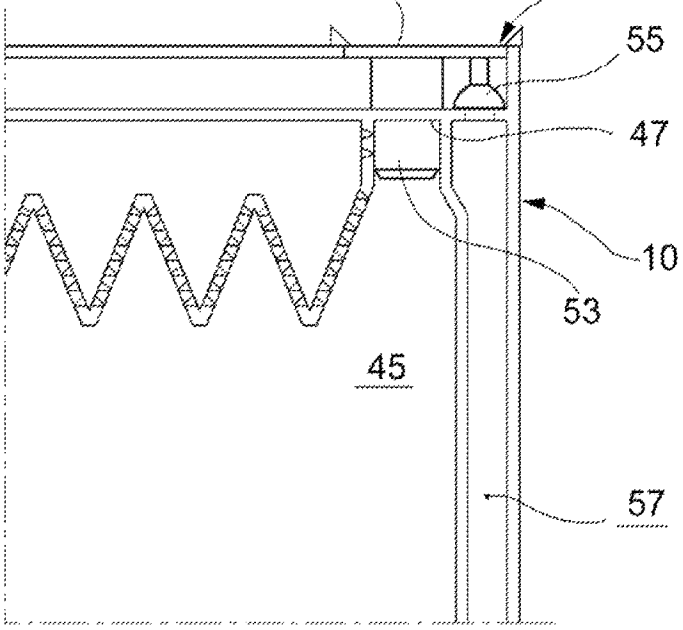
FIG. 6 is a view on an enlarged scale of a detail of FIG. 5.
Figure 5:
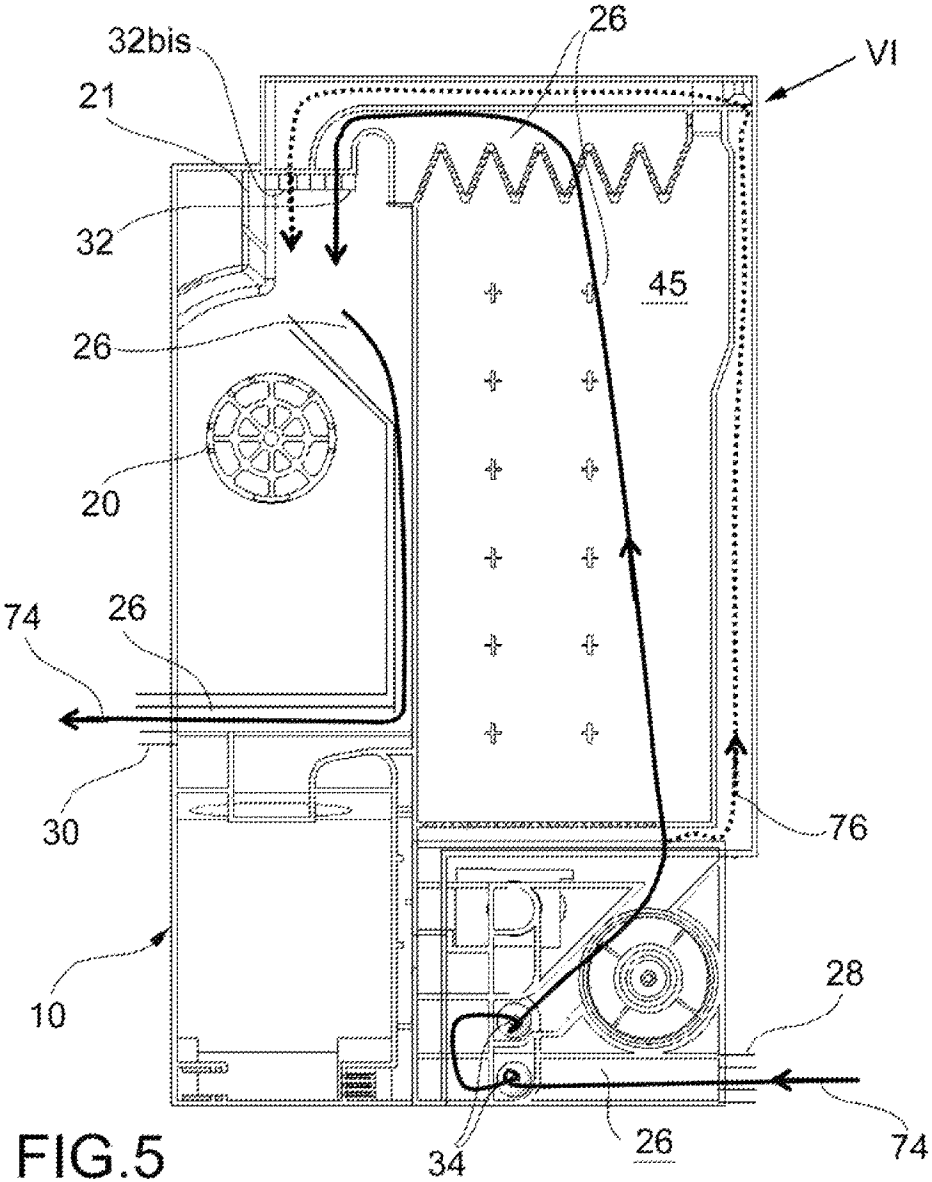
FIG. 5 is a plan view of the body of the second embodiment of the device of the invention.

The path followed by the water is indicated by the reference number 74 in FIG. 4. As may be immediately seen, the direction of the flow of water through each non-return valve 34 is substantially orthogonal to the general flow direction of the water in the conduit 26.

Advantageously, the functionality of the device of the invention may be tested immediately at the end of the production process.

Figure 9:
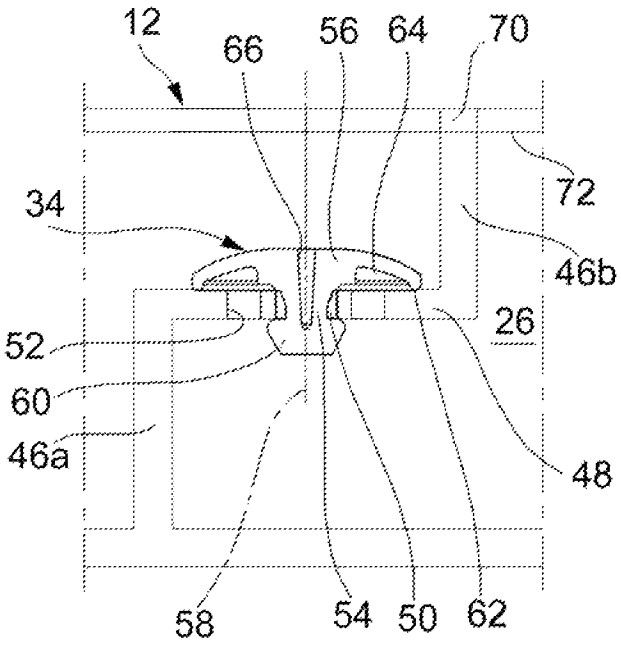
FIG. 9 is a view corresponding to FIG. 7 of a variant of the second embodiment of the device of the invention.
Figure 7:
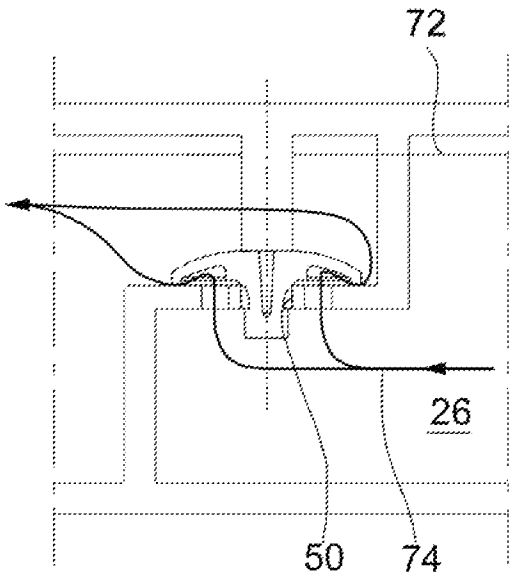
FIG. 7 is a cross-sectional view on an enlarged scale of a detail of the second embodiment of the device of the invention.
Figure 8:
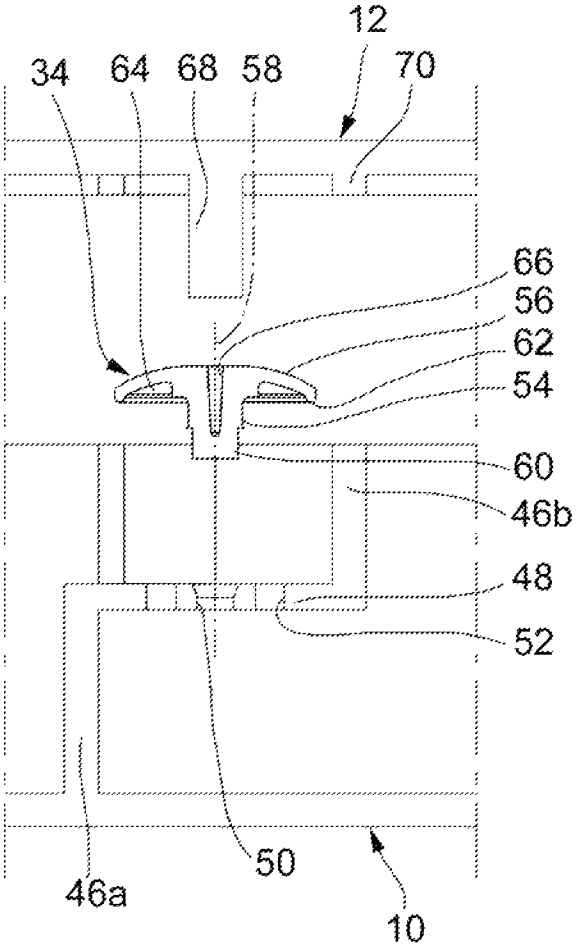
FIG. 8 is an exploded view of the components illustrated in FIG. 7.

FIG. 9, wherein the same reference numbers as those used with reference to the preceding figures indicate the same or equivalent parts, illustrates a variant of the embodiment of the device of the invention described above.

In this case, no locking pins will extend from the portion of the surface of the lid 12 facing the intermediate portion 48. The stem 54 of each valve 34 has an enlarged distal end 60 and a cross-section greater than the cross-section of the through-hole 50, so that the valve 34 is still held in place once the distal end 60 has been forced to pass through the hole 50.

The operation of the valve 34 is substantially equivalent to that described above. It goes without saying that the two different types of valves described may be used interchangeably without changing the functionality of the device.

Figure 10:
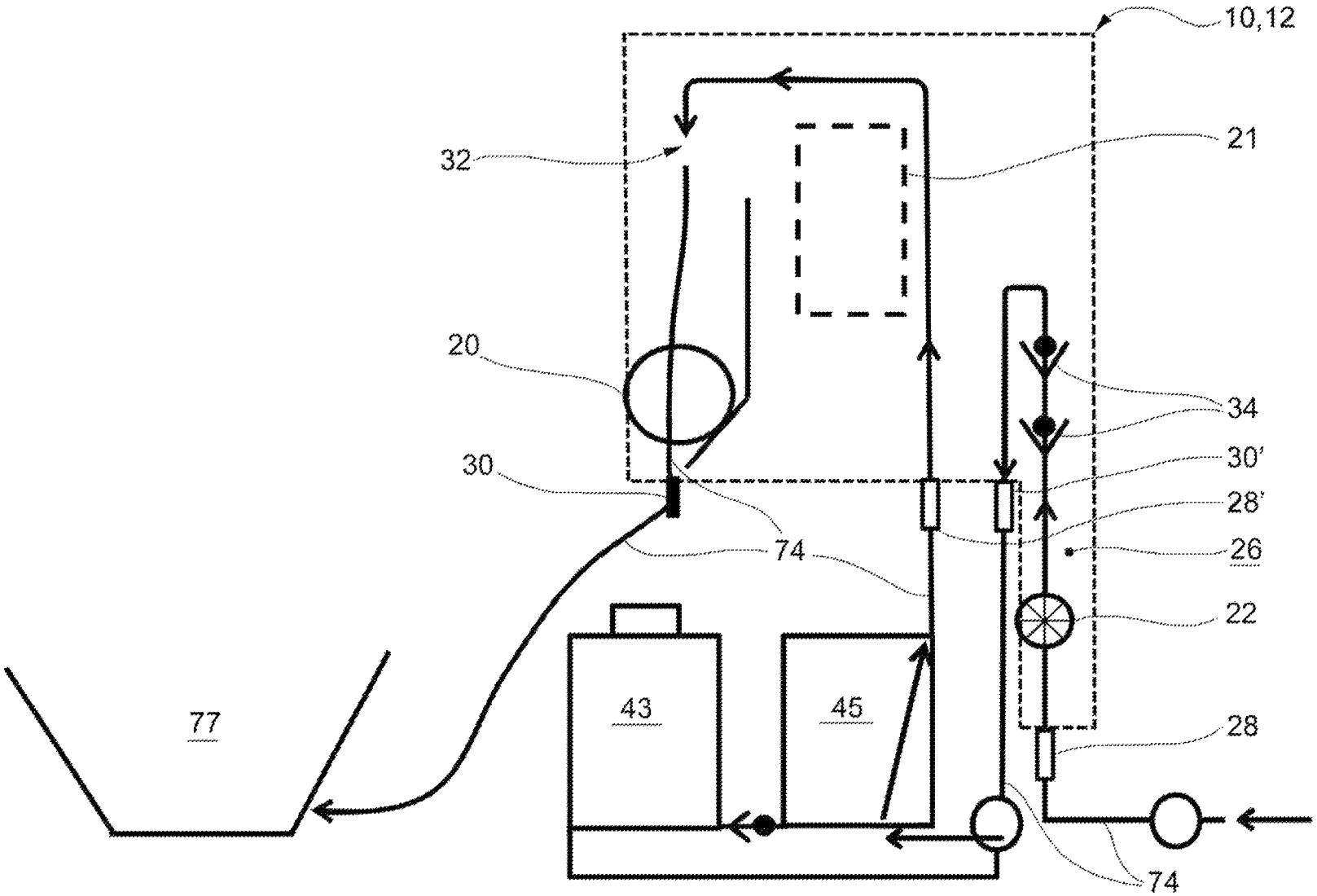
FIG. 10 is a sketch of a third embodiment of the device of the invention, wherein there are multiple inlet and outlet conduits.

A still further embodiment of the device of the invention is illustrated in the sketch in FIG. 10, wherein the same reference numbers as those used with reference to the preceding figures indicate the same or equivalent parts.

Therein, the water path 74 within the conduit 26 before the air-break 32 is exiting and then re-entering the device, since a water treatment unit (known per se) having a chamber 45 containing decalcifying resins and a regeneration salt tank 43 constitutes a separate element, which is associated with the device formed by the body 12 welded to the lid 10. There are thus two additional sleeves 30', 28' from which the water first exits and then re-enters the device to then be sent on through the path 74 obtained in the conduit 26 to the air-break 32. Also in this case, the final exit of the water from the device towards a sump 77 in the washing tub may be achieved through the sleeve 30 or through the hole 20. In this case, the water distribution device is thus made up of several elements run through by the water flow conduit 26 from an inlet 28 to an outlet 30.

The insertion of the valves 34 between the body 10 and the lid 12 offers an advantage in the testing stage, which cannot be achieved with a known configuration wherein these valves are inserted in the inlet sleeve 28. In effect, by mounting the valves 34 between the body 10 and the lid 12, it is possible to carry out a test procedure that hydraulically isolates each single valve 34 after its insertion in the body 10, and proceeds with the hydraulic testing thereof (with air or water) involving only the portion of the body 10, and in particular of the conduit 26, wherein the single valve 34 has been inserted, before welding to the lid 12. This operation is not possible if—as required by the prior art—the valves are inserted in the inlet sleeve 28, because, following the insertion and testing of the first valve, at the insertion of the second valve (which is arranged in series with the previous one in a single conduit not accessible laterally), it is not possible to verify the behavior thereof independently: the seal will in effect inevitably be a function of the first valve previously inserted.

In short, the device of the invention thus offers the advantage of allowing the sealing characteristics of each individual valve to be verified regardless of the sealing characteristics of the other valve arranged in series.

Naturally, without altering the principle of the invention, the details of implementation and embodiments may vary widely with respect to those described purely by way of example, without thereby departing from the scope of the invention as defined in the accompanying claims.

The invention claimed is:

1. A water dispensing device for a washing appliance, comprising a body and a lid which define an internal cavity and, within said internal cavity, a flow conduit for water from an inlet to an outlet an air-break being provided on said flow conduit, wherein at least one non-return valve is arranged in said flow conduit within said internal cavity and upstream of the air-break, said at least one non-return valve preventing a water backflow from a downstream section of said flow conduit into a water supply network through said inlet, wherein said at least one non-return valve consists of a single piece of elastic material having a fixed portion blocked by said body or lid and a movable portion abutting on a surface of said body or lid, and wherein said single piece of elastic material is shaped like an umbrella having a stem and a cap, wherein said body has a Z-shaped partition which extends from a side wall of a length of said flow conduit in which said at least one non-return valve is arranged and has end partition portions transverse to a general water flow direction in said flow conduit and an intermediate partition portion parallel to said general water flow direction, said intermediate partition portion having a through-hole in which said stem is inserted and at least one opening allowing water to penetrate in said at least one opening and then to flow into a volume defined by said cap and said intermediate partition portion.

2. The water dispensing device of claim 1, comprising a first and a second non-return valves arranged in series in said flow conduit within said internal cavity and upstream of the air-break.

3. The water dispensing device of claim 1, wherein said at least one non-return valve is arranged downstream of a flowmeter.

4. The water dispensing device of claim 1, wherein water flow direction through said at least one non-return valve is orthogonal with respect to said general water flow direction in said flow conduit.

5. The water dispensing device of claim 1, wherein said perimeter edge is configured to abut on a surface of said body.

6. The water dispensing device of claim 5, wherein a distal end of said stem is enlarged and has a larger cross-section than the cross-section of the through-hole.

7. The water dispensing device of claim 1, wherein a pin protrudes from a portion of the surface of the lid facing said intermediate partition portion, a distal end of said pin coming into contact with a top of said cap.

8. The water dispensing device of claim 1, wherein said flow conduit passes through a chamber containing decalcifying resins, arranged downstream of said at least one non-return valve and upstream of said air-break.

9. The water dispensing device of claim 8, wherein said chamber has an opening closed by a removable plug.

10. The water dispensing device of claim 8, further comprising a by-pass conduit arranged in parallel to said chamber and provided with a normally closed safety valve.

11. An assembly comprising the water dispensing device of claim 1, and a separate element housing a chamber containing decalcifying resins.

12. The water dispensing device of claim 1, wherein said elastic member is a helical spring.

13. The water dispensing device of claim 1, wherein said single piece of elastic material is a synthetic or natural elastomer.

14. A method for producing a water dispensing device for a washing appliance, the water dispensing device comprising a body and a lid which define an internal cavity and, within said internal cavity, a flow conduit for water from an inlet to an outlet, an air-break being provided on said flow conduit, wherein at least one non-return valve is arranged in said flow conduit within said internal cavity and upstream of the air-break, said at least one non-return valve preventing a water backflow from a downstream section of said flow conduit into a water supply network through said inlet, wherein said at least one non-return valve consists of a single piece of elastic material having a fixed portion blocked by said body or lid and a movable portion abutting on a surface of said body or lid, wherein said single piece of elastic material is shaped like an umbrella having a stem and a cap, wherein said body has a Z-shaped partition which extends from a side wall of a length of said flow conduit in which said at least one non-return valve is arranged and has end partition portions transverse to a general water flow direction in said flow conduit and an intermediate partition portion parallel to said general water flow direction, said intermediate partition portion having a through-hole in which said stem is inserted and at least one opening allowing water to penetrate in said at least one opening and then to flow into a volume defined by said cap and said intermediate partition portion, and wherein said method providing that said at least one non-return valve is assembled to said body and subsequently the lid is fixed to said body.

* * * * *